US008898834B1

(12) United States Patent
Huber et al.

(10) Patent No.: US 8,898,834 B1
(45) Date of Patent: Dec. 2, 2014

(54) STABILIZING AND HYBRID BEDDING SHEETS FOR A BED DRESSING AND A SET THEREOF

(76) Inventors: Stefanie Bryan Huber, Venice, CA (US); Janae' S. Giurlani, Reno, NV (US)

( * ) Notice: Subject to any disclaimer, the term of this patent is extended or adjusted under 35 U.S.C. 154(b) by 245 days.

(21) Appl. No.: 13/475,548

(22) Filed: May 18, 2012

Related U.S. Application Data

(60) Provisional application No. 61/519,313, filed on May 20, 2011.

(51) Int. Cl.
*A47C 31/10* (2006.01)

(52) U.S. Cl.
USPC ..... 5/498; 5/494; 5/486; 5/482; 5/495; 5/502

(58) Field of Classification Search
USPC ..... 5/636, 482–502
See application file for complete search history.

(56) References Cited

U.S. PATENT DOCUMENTS

| | | | | |
|---|---|---|---|---|
| 2,662,234 | A | 12/1953 | Citron | |
| 4,924,543 | A | 5/1990 | Hoss et al. | |
| 5,084,929 | A | 2/1992 | Staudinger | |
| 7,380,297 | B2 | 6/2008 | Bauer | |
| 7,530,124 | B1 | 5/2009 | Wootten, Jr. | |
| 2009/0178197 | A1 * | 7/2009 | Swihart et al. | 5/496 |

* cited by examiner

*Primary Examiner* — Peter M Cuomo
*Assistant Examiner* — Brittany Wilson
(74) *Attorney, Agent, or Firm* — Lazaris IP

(57) ABSTRACT

A bed dressing and set includes several articles of bed linens or bed clothing. A top sheet includes a plurality of apertures configured to accept at least one fastener along ends of a bottom sheet. The bottom sheet includes straps which extend from a substantially central portion along foot and head ends to engage with multiple sidewall points to secure the bottom sheet in place on top of a mattress. Together, the bottom sheet and top sheet substantially eliminate the possibility of bed clothing moving out of a stable position when the bed is in use, creating an adjustable personal fit for the bed occupant to improve sleep quality and comfort.

20 Claims, 4 Drawing Sheets

STABILIZING AND HYBRID BEDDING SHEETS FOR A BED DRESSING AND A SET THEREOF

CROSS REFERENCE TO RELATED PATENT APPLICATIONS

This patent application claims priority to U.S. provisional application 61/519,313, filed on May 20, 2011, the contents of which are incorporated in their entirety herein.

STATEMENT REGARDING FEDERALLY-SPONSORED RESEARCH OR DEVELOPMENT

Not applicable.

FIELD OF THE INVENTION

The present invention relates generally to bedding and bed linens or clothing. More specifically, particular embodiments of the invention relate to bedding sheets and a set of one or more items comprising a bed dressing, and a method of dressing a bed.

BACKGROUND OF THE INVENTION

Conventional bed linens and clothing, and sets thereof, comprising a bed dressing typically include a pillow covering, a fitted sheet, a flat sheet, a blanket, and other components such as quilts, bedspreads, comforters, duvets and the like. Dressing a bed for warmth and comfort is a prelude to a satisfying night's rest. In such conventional bed dressings, the fabrics often begin moving from their made-up position when one occupies the bed, leaving the bed clothing unmanageable, the occupant uncomfortable, and an undisturbed repose unobtainable.

Stability of such bed clothing is therefore an issue bed occupants must contend with in conventional bed dressings. Traditionally, bed clothing is secured by tucking bed clothes under a mattress. This technique, however, can restrict the bed occupant from normal body movement. The natural need to create space within tucked coverings often leaves bed clothes tousled and unmanageable, awakening the occupant from much needed rest or, at a minimum, disrupting sleep. Additionally, space and warmth can often work against each other. The more space within the bed clothing, the more unstable the bed dressing becomes, and the more uncomfortable the occupant. Bed clothing manufacturers have long sought means of effectively securing bed clothes to fit the personal needs of occupants.

U.S. Pat. No. 7,530,124 to Wootten, Jr. and U.S. Pat. No. 2,662,234 to Citron are examples of prior art bed dressings that attempt to address the need to stabilize the fitted sheet. In both, corner straps are disclosed on an underside of the fitted sheet, sewn diagonally at each corner and having ends of elastic or flexible bands secured to the adjacent walls at each corner. With both of these designs, the fitted sheets are retained on the mattress at each corner, but the elastic or flexible bands can easily slip off the mattress. While the corner straps of these prior art patents may retain the fitted sheets on the mattress, neither is designed to securely hold the fitted sheet to the mattress as contemplated in the present invention.

Citron stabilizes the placement of a top sheet using a non-adjustable, permanently-attached sheet joined to the fitted sheet. This provides a unitary assembly of the flat and fitted sheet, which attempts to minimize displacement of the top sheet. The top sheet is joined together by at least one row of stitches which extend around the corners of the fitted sheet ends and then longitudinally for a short distance. This, however, does not address adjustability of the bed clothing, or provide flexibility for attachment of other bed clothes such as blankets, quilts, bedspreads or the like.

U.S. Pat. No. 5,084,929 to Staudinger disclosed bed clothing in which a flat sheet is attached to the fitted sheet by seams sewn around the foot and sidewalls of the fitted sheet. A portion of the flat sheet is not permanently attached at the head of the bed dressing, where a releasable, fixed fastener is placed on each side. A straight elastic strap connects each side underneath the fitted sheet to create stability. However, the fasteners and compatible coverings do not have the ability to accommodate additional bed clothing. Moreover, sewing the sheets together leaves the occupant with no adjustable means to fit personal needs.

Another prior art method of optimizing placement of bed clothing is disclosed in U.S. Pat. No. 7,380,297 to Bauer. In this prior art patent, a flat sheet with an added zone of expansion for foot movement emulates the traditional fitted sheet style, adhering to the foot of the mattress for stability. Blankets, quilts, bedspreads and the like also fit in the same fashion. There is, however, no means of stability for the middle and upper sections of the bed clothing, and traditional tucking of bedclothes is still needed for the rest of the bed dressing set.

Existing pillow coverings, such as for example pillow cases and shams, can leave a sleeper feeling frustrated, as the pillow often slips out during normal sleep movement. Some pillow cases have zippers, hooks and loops such as Velcro™, or buttons to ensure stability. Typical pillow shams have a mid-positioned split of overlapping fabric for entry on the outer surface at the back, leaving only one side smooth. And still others attach a downward-facing shallow cuff along an inner entry wall in hopes of catching the pillow before it slips out. One example of a conventional pillow covering is U.S. Pat. No. 4,924,543 to Hoss, which discloses integrally-mounted pillow slots within a fitted sheet to establish pillow stability. This, however, leaves the sleeper's head adjusting to the pillow and sheet, rather than the pillow adjusting to the sleeper's movement.

Such prior art bed dressings represent attempts to steady and stabilize bed clothing in one way or another for bed occupants. However, all have significant limitations that indicate an unresolved need for ways to make bed occupants more comfortable, for both children and adults. For an occupant to benefit fully from any improved bed clothing, the bed dressing needs to be stable, adaptable and adjustable. Therefore, it is one objective of the present invention to provide a comfortable and stable bed dressing for both children and adults that improves the ability of the bed occupant to enjoy restful sleep.

BRIEF SUMMARY OF THE INVENTION

The present invention addresses the various prior art limitations by providing a stable, adjustable bed dressing for children and adults that is easy to apply to a bed. The present invention discloses a sheet that has disposed thereon mutual fastening points that correspond to and are compatible with fastening mechanisms on another sheet. This allows the two sheets, and any additional bed clothing also having compatible fastening mechanisms or mutual fastening points disposed thereon, to be applicable to a mattress of a bed so that tucking of sheets and bed clothing is not needed. These mutual fastening points and corresponding compatible fastening mechanisms allow the bed dressing to be adjustable to create a personal fit for the bed occupant.

The present invention also discloses strap arrangements that provide substantially "V"-shaped elastic support mechanisms on an underside of a fitted sheet. The V-shaped straps connect head and foot ends of the fitted sheet with left and right ends on the underside thereof to provide a firm, stable positioning of the fitted sheet when deployed on a mattress.

Together, these features of the present invention provide a steady, adjustable, and comfortable sleeping environment for a bed occupant. The bed dressing is easy to apply to a mattress of the bed, so that the tradition of laborious tucking and its attendant unequal result is no longer necessary to steady bed clothing.

The present invention also discloses a dual-sided, sleeper-friendly secure pillow case that has an easy entrance, outer smoothness, and an inner security pocket. The inner security pocket is fixed and has a closure atop the pocket, creating an easy to use pillow case from which a pillow cannot easily slip out. The inner security pocket adheres to the middle and lower portions of one inner pillow case wall. An inlaid flap is attached on the top and middle portions of the opposite inner wall. Together, these two interior walls are sandwiched together and simultaneously sewn with the outer pillow case seams. As a result, the inner security pocket and flap have the ability to work together, securing the pillow inside the case. When dressing the pillow, one rolls the outside case out and down to meet the top of the security pocket. The bed dresser slips the pillow into the inner security pocket, and pulls the flap over the top of the pillow. The flap is sewn so its fabric end naturally lies inside the inner security pocket. The bed dresser then pulls the outer case up to secure the pillow. The bed occupant is left with a secure, smooth, comfortable pillow. Sewing and placement techniques for the inner security pocket and hood may vary as production efficiency and costs are considered.

In addition to stabilizing adult and children's bed dressings, the present invention also realizes a reduction in the labor investment attendant to traditional bed making. This is accomplished by eliminating tucking through employment of adjustable, removable and adaptable bed clothes to fit individual needs, and by the application of an anchored, fitted sheet with top and bottom "V"-shaped elastic straps that meet specific attachment points to steady the bed dressing. Other embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the accompanying figures which form a part thereof, and in which is shown, by way of illustration, exemplary embodiments illustrating the principles of the present invention and how it is practiced. Other embodiments will be utilized to practice the present invention and structural and functional changes will be made thereto without departing from the scope of the present invention.

Figure 1:
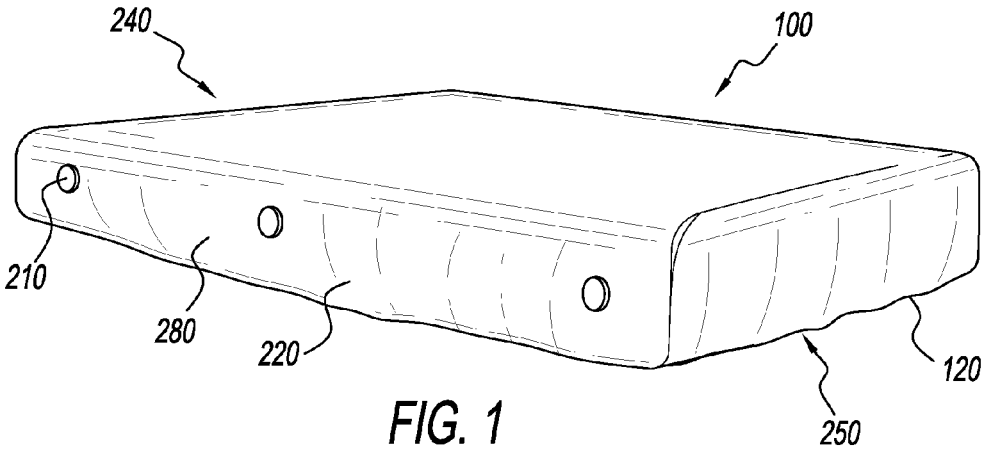
FIG. 1 is a perspective view of a bottom sheet of a bed dressing affixed to a mattress according to the present invention.
Figure 2:
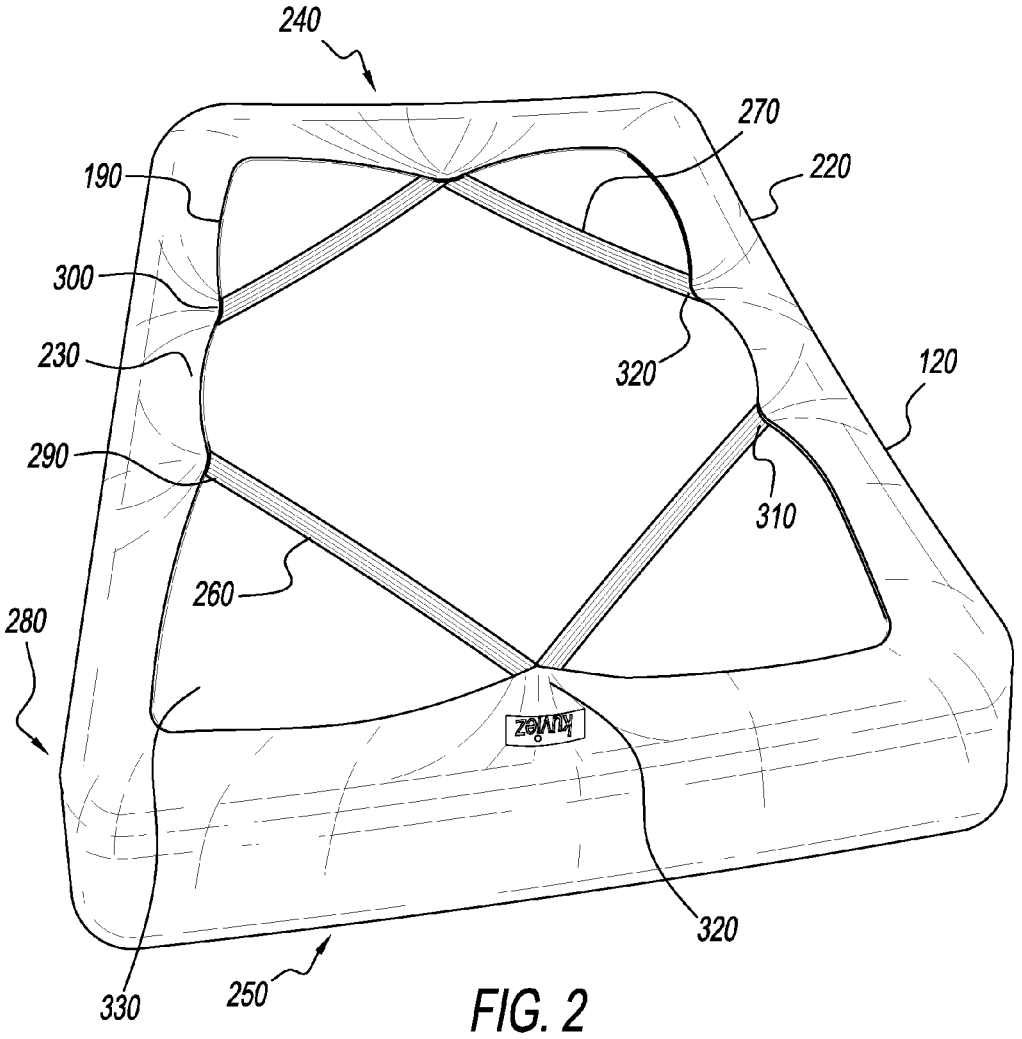
FIG. 2 is an additional view of an underside of a bottom sheet of a bed dressing affixed to a mattress according to the present invention.
Figure 3:
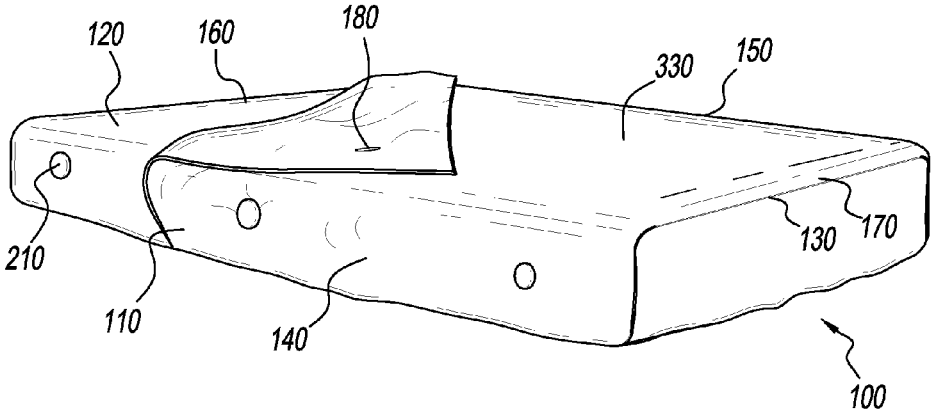
FIG. 3 is a further perspective view of a bed dressing according to the present invention.

FIG. 1 is a perspective view of a portion of a bed dressing 100 according to the present invention. The bed dressing 100 includes a top sheet 110 and a bottom sheet 120. In FIG. 1, the bottom sheet 120 is applied to a mattress 330 and includes a plurality of fasteners 210 disposed at least along the left and right longitudinal ends, or sides, 220 and 230, of the bottom sheet 120. The plurality of fasteners 210 extend from an outer surface 280 of the bottom sheet 120 and are sewn or otherwise affixed to the bottom sheet 120 to engage with apertures 180 in the top sheet 110, as shown in FIG. 3. FIG. 2 is an additional view of an underside of a bottom sheet 120 of a bed dressing 100 applied to the mattress 330.

The top sheet 110 includes an edge 130, and four ends—a left end 140, a right end 150, a head end 160, and a foot end 170. Extending along the left end 140 and the right end 150 are the plurality of apertures 180, which are capable of accepting the plurality of fasteners 210 in the bottom sheet 120 and engaging with the plurality of fasteners 210 to couple the top sheet 110 to the bottom sheet 120.

The bottom sheet 120 includes a head end 240 and a foot end 250, as well as an edge 190. In one embodiment, at least a portion of the edge 190 comprises a fitted portion 200. The entire edge 190 may be a fitted portion 200 in one embodiment, while in another embodiment the fitted portion 200 of the edge 190 may be only in the various corners thereof.

Regardless, the bottom sheet 120 also includes a plurality of strap arrangements that comprise a first strap arrangement 260 extending from the foot end 250, and a second strap arrangement 270 extending from the head end 240. Each such strap arrangement includes first and second straps that connect to points on the left and right ends 220 and 230 of the bottom sheet 120. In the first strap arrangement 260, a first strap on one side thereof connects to a first point 290 on the right end 230, and a second strap on a second side thereof connects at a first point 310 on the left end 220. Similarly, in the second strap arrangement 270, a first strap on one side thereof connects at a second point 300 on the right end 230, and a second strap on a second side thereof connects at a second point 320 on the left end 220. When deployed, the strap arrangements 260 and 270 allow the bottom sheet 120 to remain in place on top of the mattress 330 to securely position the bed dressing 100 to the mattress 330 without risk of the bottom sheet 120 moving out of a stable position when the bed is occupied.

The first strap arrangement 260 and the second strap arrangement 270 each connect to the respective foot end 250 and the head end 240 at a substantially central position along the edge 190 at each of the foot end 250 and the head end 240 of the bottom sheet 120. At least the foot end 250 of the bottom sheet 120 includes an identification portion or marker 340 at the substantially central position along the edge 190 at the foot end 250 to assist the bed dresser in lining up the bottom sheet 120 with the foot end of the mattress 330. It is to be understood that both the foot end 250 and head end 240 may each have some identification portion 340. The marker 340 may include type of indicia suitable for providing the bed dresser with a means for lining up the bottom sheet 120 for application to the mattress 330.

In one embodiment, the first strap arrangement 260 and the second strap arrangement 270 each substantially form a "V"-shaped arrangement of elastic or otherwise flexible straps which are sewn, in the first strap arrangement 260, to both the foot end 250 and the left and right ends 220 and 230, and in the second strap arrangement 270, to the head end 240 and the left and right ends 220 and 230, on the bottom sheet 120. The elastic straps of each strap arrangement substantially mirror one another on the underside of the bottom sheet 120. At both the head end 240 and the foot end 250, the first and second strap arrangements 260 and 270 are sewn at the substantially central position to form the connection point in the "V" shape. Each "V"-shaped strap arrangement stretches out to and is sewn at each of the respective first and second points on the left end 220 and the right end 230. The first and second points 290 and 300 on the right end 230 may be at any point along the right end 230 that enables a stable positioning of the bottom sheet 120 to the mattress 330 when the first strap arrangement 260 is deployed. Similarly, the first and second points 310 and 320 on the left end 220 may be at any point along the left end 220 that enables a stable positioning of the bottom sheet 120 to the mattress 330 when the second strap arrangement 270 is deployed.

It is to be understood that the elasticity and shape of the straps in each strap arrangement may vary. It also to be understood that many different methods of connecting the straps to both the head and foot ends 240 and 250, and left and right ends 220 and 230 may be employed and are within the scope of the present invention. For example, different stitching may be used at the substantially central position on the head end 240 and foot end 250 than is used on the left and right ends 220 and 230. Similarly, different types of connections may be employed—for example, a hook and loop system may be used. Regardless, it is contemplated that many types of connections and sewing may be used, and may be used together with each other, to attach ends of the strap arrangements to the edge 190 of the bottom sheet 120.

Together, the top sheet 110 and the bottom sheet 120 allow the bed dresser to dress a bed with the bed dressing 100 so that the top sheet 110 engages with the bottom sheet 120 using the plurality of fasteners 210 applied to the plurality of apertures 180 in the top sheet 110. When both the top sheet 110 and the bottom 120 are applied to a mattress 330, and fully or partially attached together using the plurality of fasteners 210 and plurality of apertures 180, both the head end 160 and the foot end 170 of the top sheet 110 are loose and do not need to be tucked underneath the mattress 330. This has several advantages and benefits as discussed herein for both the bed dresser and the occupant or sleeper in the bed.

One such advantage and benefit is that the bed can be dressed in a quicker and easier manner. Because the bed dresser does not have to tuck the top sheet 110 under the mattress 330, this eliminates an uneven application of the bed dressing 100 and also alleviates strain on the bed dresser from having to lift the mattress 330. Further, the top sheet 110 and the bottom sheet 120 can simply be smoothed out together to create a clean, well-made, and even appearance.

Another advantage and benefit is, in the case of children's bedding, that a child occupying the bed remains snug between the top sheet 110 and the bottom sheet 120. The child does not suffer from interrupted sleep from the top sheet 110 coming undone from the bottom sheet 120, or from either the top sheet 110 or bottom sheet 120 coming untucked from the mattress 330. In this regard, both the strap arrangements 260 and 270, and the ability of the top sheet 110 to engage with the bottom sheet 120 so that the top sheet does not need to be tucked, provide a secure and stable sleeping environment for a child occupying a bed.

Yet another advantage and benefit of the plurality of fasteners 210 and plurality of apertures 180 that allow the top sheet 110 to engage with the bottom sheet 120 is a free flow of air in the bed. Because the top sheet 110 is untucked relative to both the bottom sheet 120 and the mattress 330, it creates openings at both the head end 160 and foot end 170 of the top sheet relative to the bottom sheet 120. The openings allow for "breathing space" for bed linens while occupants are in the bed. This keeps the bed dressing fresh and clean for bed occupants.

Figure 5:
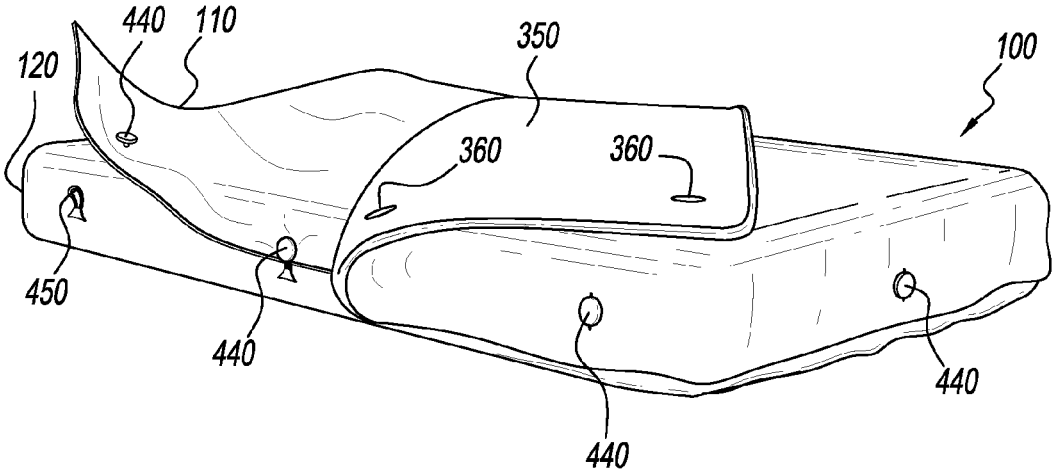
FIG. 5 is an additional perspective view of a bed dressing according to one embodiment of the present invention.

The plurality of fasteners 210 in the bottom sheet 120 (as shown in FIG. 1 and FIG. 3) and the plurality of fasteners 440 in the top sheet 110 (as shown in FIG. 5) are contemplated to include any type of fastening mechanism that is capable of removably securing the top sheet 110 to the bottom sheet 120 through either the plurality of apertures 180 or the plurality of loops 450. Examples include but are not limited to buttons or other attachment mechanisms of any size, shape or material, such as buckles, zippers, snaps, drawstrings, magnets, covered magnets, covered cords with cord locks, ties laced through grommets, elastic loops with hooks, hook and loop mechanisms, and other similar means of attachment. Such fasteners may be attached to the bottom sheet 120 or the top sheet 110 by any known method of attachment, such as for example by thread sewn onto the sheets themselves or via another intermediate material. For example, in one embodiment, a piece of elastic is looped through each button, and the elastic material is sewn to either the top sheet 110 or the bottom sheet 120 (depending on whether it is a adult or child embodiment). In one further embodiment, it is contemplated that a piece of elastic is first sewn to the top sheet 110 or bottom sheet 120 (depending on whether it is an adult or child embodiment), and at least one button is then sewn to the elastic material. In these embodiments, the elastic material, rather than a fastener, is sewn to the top sheet 110 or bottom sheet 120, creating a very durable product that permits an easier environment for stretching and movement of the occupant. The occupant or dresser of the bed may also therefore adjust the fit of the top sheet 110 to the bottom sheet 120 as desired, creating a very flexible and breathable bedding environment.

In an alternative embodiment, the plurality of fasteners 210 may be positioned closer to the edge 190 of the bottom sheet 120, so that they lie underneath the mattress 330 when the bottom sheet 120 is applied thereto. When the bottom sheet 120 is applied to a mattress 330, a portion of the bottom sheet 120 extending from the edge 190 thereof lies underneath the mattress 330. This configuration of the plurality of fasteners 210 represents a variation from having the attachment points on the left, right and where applicable, foot ends of the bottom sheet 120. Positioning the bottom sheet 120 fasteners 210 to lie under the mattress 330 when the bottom sheet 120 is placed on the mattress 330 prevents the plurality of fasteners 210 from being a hazard for children. It also allows both adult and child bedding to have a traditional, clean look. In this embodiment, the plurality of fasteners 210 are coupled to the plurality of apertures 180 in the top sheet 110 (in the embodiment of FIG. 1-3) and vice versa (in the embodiment of FIG. 5) before applying the bed dressing 100 to the mattress 330 to prevent heavy lifting from having to affix the fasteners 210 and apertures 180 after the bed dressing 100 has been applied to the mattress 330. It is therefore to be understood that a plurality of apertures 180 may be positioned closer to the edge 190 of the bottom sheet 120 as in the embodiment of FIG. 5, so that they lie underneath the mattress 330 when the bottom sheet 120 is applied thereto.

In a further alternative embodiment, the bottom sheet 120 may include one or more slits along a point near the edges of one or more ends therein, with the plurality of fasteners 210 positioned on an underside portion of the bottom sheet 120 inside side panels created by the one or more slits. This configuration represents a further variation from having the plurality of fasteners 210 positioned on the outer left 220, right 230 and foot 250 ends, so that the bottom sheet 120 and additional bed dressing pieces 350 are visibly attached on the outer ends. Instead, the bottom sheet 120 includes the one or more slits, which are either hidden or visible openings near the left 220, right 230 and/or foot 250 ends that extend through to the underside of the bottom sheet 120. These openings may vary in size and shape. They may be long, thin, visible, elasticized slits for easy stretching, or they may be covert, circular and without elastic. Regardless, the top sheet 110 is to be customized to thread through these bottom sheet 120 openings, either with its own material and/or with added attachment portions. Once the top sheet 110 and any attachment portions are placed through these openings, the top sheet 110 fastens to the underside portion of the bottom sheet 120. It is further contemplated that the underside portion of the bottom sheet 120 may carry additional fabric layers designed for attachment point purposes.

In still another embodiment of the present invention, the bottom sheet 120 may be fitted with additional outer panels on the left and right ends 220 and 230 thereof for attachment to the top sheet 110. These outer panels serve as extensions of the bottom sheet 120 and may be elastic or comprised of material that is different than that of the bottom sheet 120 to which they are attached. Regardless, it is contemplated that these additional outer panels are to be fabric that may be sewn onto the bottom sheet 120, either on the outside portion or on the underside portion, so as to absorb the effect of direct pulling on the bottom sheet 120 when the top sheet 110 is attached thereto. This also allows for expansion of the available room between the top sheet 110 and bottom sheet 120 to create more comfortable bed dressing 100 environment and also a stronger product.

The outer panels may also be configured so that, in yet another embodiment, they extend out from a specific portion of each of the left and right ends 220 and 230 of the bottom sheet. For example, panels may extend from portions of the left and right ends 220 and 230 near the head end 240 of the bottom sheet 120, so that the top sheet 110 affixes to fasteners 210 in the bottom sheet at these outer panels. A further attachment point be included at the foot end 250 of the bottoms sheet 120, and/or at any other specific point along each of the left end 220 and right end 230, to create and promote free-flowing air between the top sheet 110 and the bottom sheet 120.

FIG. 3 is a further perspective view of the bed dressing 100 of the present invention. FIG. 3 shows the top sheet 110 attached to the bottom sheet 120 on the mattress 330 in one embodiment, as well as a first additional bed dressing piece 350 applied above the top sheet 110. FIG. 3 shows the top sheet 110 affixed to the bottom 120 by having at least some of the plurality of fasteners 210 along one side of the bottom sheet 120 engaged with the plurality of apertures 180 in the top sheet 110. FIG. 3 also shows that some of the plurality of apertures 180 can be left unengaged, so that the top sheet 110 can be affixed to the bottom sheet 120 as desired by an occupant of the bed or dresser of the bed dressing 100.

Similarly, the first additional bed dressing piece 350 may also be attached to the bottom sheet 120 in the bed dressing 100. The first additional bed dressing piece 350 also includes a plurality of apertures 360. Some or all of the plurality of apertures 360 may also be engaged with the plurality of fasteners 210 in the bottom sheet 120. The present invention contemplates that any number of additional bed dressing pieces 350 may be including in the bed dressing 100 and applied to the bottom sheet 120, regardless of whether the top sheet 110 has been applied and regardless of whether any other additional bed dressing piece 350 is present. The first additional bed dressing piece 350, and subsequent bed dressing pieces applied to the bed dressing, may be additional sheets, blankets and/or any other type of bed coverings in conventional bed dressing sets, such as comforters, bed spreads, duvets, and the like.

Figure 4A:
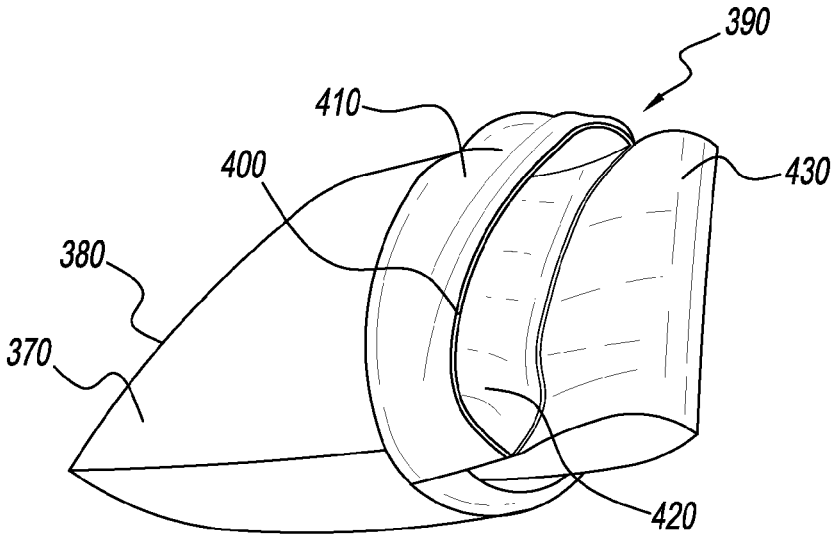
FIG. 4A is a perspective view of a pillow case of a bed dressing according to the present invention.
Figure 4B:
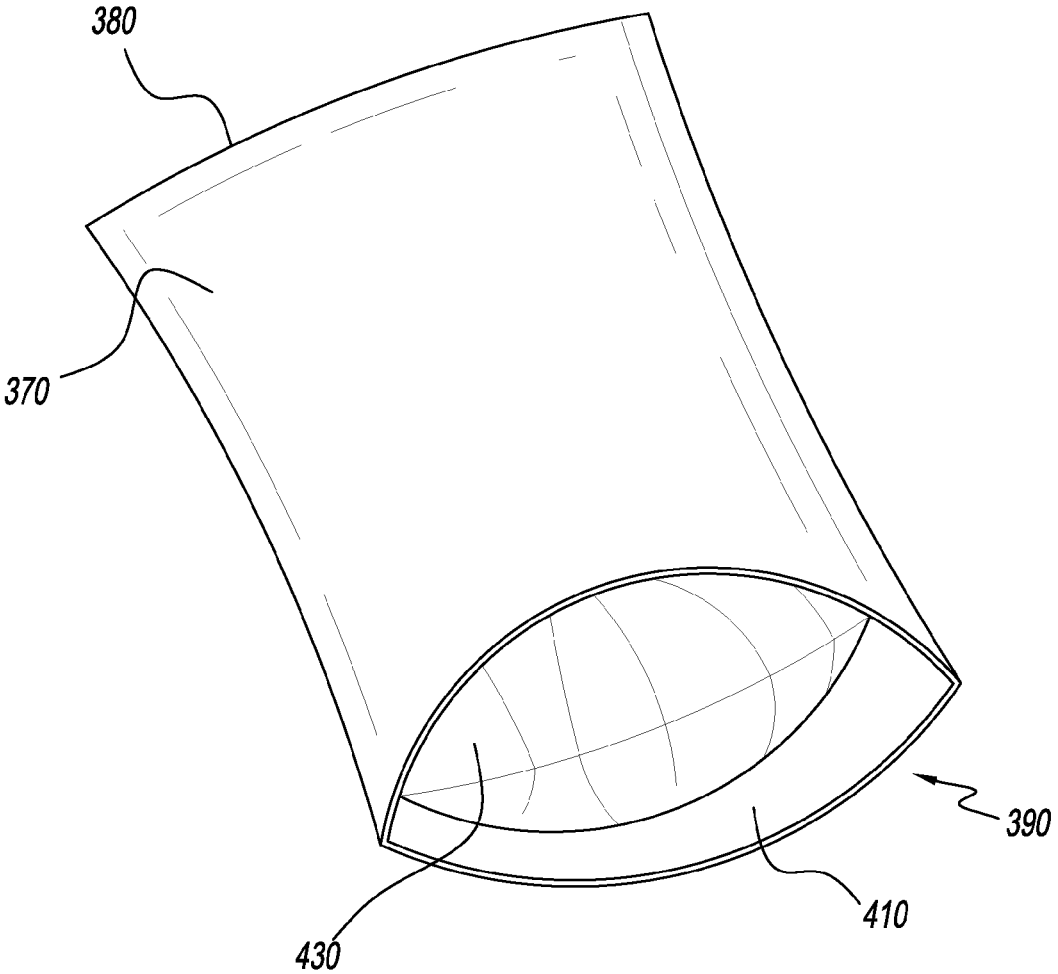
FIG. 4B is a further perspective view of a pillow case of a bed dressing according to the present invention.

The bed dressing 100 may also include one or more pillow cases 370. FIG. 4A is a perspective view of a pillow case 370 of a bed dressing 100, and FIG. 4B is a further perspective view. The pillow case 370 includes a closed end 380 and an open end 390. An internal pocket 400 is formed on at least a portion of an inside portion 410 of the pillow case 370. The internal pocket 400 includes a flap 420.

The pillow case 370 is designed so that when a pillow 430 is inserted through the open end 390 and into the internal pocket 400, the pillow 430 remains with the internal pocket 400 and does not become un-secured from inside the pillow case 370. This provides additional comfort for the sleeper by preventing sleep interruptions associated with adjusting pillows 430 that through movement become removed from inside the pillow case 370. The design of pillow case 370, together with other aspects of the present invention, also aids in providing a clean, well-made appearance when the bed dressing 100 is applied to a bed.

The pillow case 370 is also designed to be quickly prepared by the bed dresser. At the open end 390, the sides of the pillow case 370 are rolled down outwardly toward the closed end 380. Once the flap 420 of the internal pocket 400 is reached, the bed dresser pulls back the flap 420 and inserts the pillow 430 inside the internal pocket 400. Once the pillow 430 has been inserted fully into the internal pocket 400, the flap 420 is pulled over the end of the pillow 430 so that the pillow 430 is secured completely inside the internal pocket 400. The bed dresser then unrolls the sides of the pillow case 370 away from the closed end 380.

As noted herein, in one embodiment the present invention is well-suited for dressing beds to be slept in by children who have difficulty falling and staying asleep, because movement in the bed dislodges one or more of the components of a bed dressing, making children cold or otherwise uncomfortable. One objective of the present invention is therefore to provide a bed dressing that improves the quality and length of sleep for children. By providing a secure, stable bed environment, children stay comfortable and warm for longer periods, increasing their ability to fall and remain and asleep and increasing the chances of lengthy and satisfying sleep. By securing the bottom sheet 120 to the mattress 330 using the strap arrangements 260 and 270, securing the top sheet 110 to the bottom sheet 120 using the plurality of fasteners 210 and the plurality of holes 180, securing pillows 430 inside pillow cases 370, and securing additional bed dressing pieces 350 to the bottom sheet 120, children can feel safe and secure inside their beds and experience better and longer sleeping periods.

FIG. 5 is a perspective view of a bed dressing 100 adapted for use on an adult bed according to another embodiment of the present invention. In the embodiment of FIG. 5, the bottom sheet 120 includes a plurality of loops 450, and the top sheet 110 includes a plurality of fasteners 440. Additional bed dressing pieces 350 have apertures 360 for engaging with the fasteners 440 of the top sheet 110.

The plurality of fasteners 440 in the top sheet 110 extend along both the left end 140 and the right end 150 thereof. An additional fastener 440 is contemplated at the foot end 170 to keep at least top sheet 110 in place on the bottom sheet 120 while the bed is being slept in, particularly where most or all fasteners 440 on the left and right ends 140 and 150 of the top sheet 110 have been removed from the plurality of loops 450.

In such an adult bed dressing 100 as shown in FIG. 5, the configuration of fasteners 440 on the top sheet 110 allows the person occupying in the bed to easily and quickly adjust the amount of covering being used. Rather than keeping the occupant snug and firm in the bed dressing as with the child embodiment, the adult bed dressing 110 of the embodiment of FIG. 5 allows the occupant to easily apply the top sheet 110 (and any additional bed dressing pieces 350) to the bottom sheet 120 when a firmer or warmer bedding or sleeping environment is desired, or to remove the top sheet 110 (and any additional bed dressing pieces 350) from the bottom sheet 120 if a more comfortable or cooler bedding or sleeping environment is desired.

It is to be understood that any means of accepting the plurality of fasteners 440 in the top sheet 110 may be employed in the bottom sheet 120. Therefore, any means of performing the same function as the plurality of loops 450 may be utilized to secure the top sheet 110 to the bottom sheet 120.

Regardless of whether the present invention is to be applied to child or adult beds, another embodiment includes a method of easily and quickly dressing a bed. In such an embodiment, the bed dresser begins by lining up the identification portion 340 on the bottom sheet 120 with the center of the foot end of the mattress 330. The mattress 330 may also include an identification portion or marker to further aid the bed dresser in lining up the bottom sheet 120 for application to the mattress 330.

The bed dresser then applies the bottom sheet 120 to the mattress 330 at the foot end 250 of the bottom sheet 120. This is done by deploying the straps of the strap arrangement 260 at the foot end 250 underneath the mattress 330. The bed dresser then moves to the head end 240 of the bottom sheet 120 and deploys the straps of the strap arrangement 270 underneath the mattress 330. Together, the strap arrangements 260 and 270 keep the bottom sheet 120 taut on the mattress 330 by pulling on the head end 240, the foot end 250, the first and second points 290 and 300 on the right end 230, and the first and second points 310 and 320 on the left end 230. The bed dresser then may smooth out any inconsistencies in the bottom sheet 120 on top of the mattress 330 and move on to applying the top sheet 110.

In the bed dressing 100 of the child embodiment, the bed dresser then applies the top sheet 110 on top of the bottom sheet 120 and lines up the plurality of apertures 180 with the plurality of fasteners 210 along each of the left and right ends 140 and 150 of the top sheet 110 and the left and right ends 220 and 230 of the bottom sheet 120. The bed dresser may engage all or some of the apertures 180 with the fasteners 210, as desired. Regardless, once the apertures 180 are engaged with the fasteners 210, the bed dresser may then smooth out the top sheet 110 to remove any inconsistencies therein to create a smooth and well-made appearance. Similarly, the bed dresser may then apply any additional bed dressing pieces 350 as desired.

In the bed dressing 100 of the adult embodiment, the bed dresser applies the top sheet 110 on top of the bottom sheet 120 and lines up the plurality of fasteners 440 in the top sheet 110 with the plurality of loops 450 in the bottom sheet 120 along each of the left and right ends 140 and 150 of the top sheet 110 and the left and right ends 220 and 230 of the bottom sheet 120. The bed dresser may engage all or some of the plurality of loops 450 with the plurality of fasteners 440, as desired. Regardless, once the loops 450 are engaged with the fasteners 440, the bed dresser may then smooth out the top sheet 110 to remove any inconsistencies therein to create a smooth and well-made appearance. Similarly, the bed dresser may then apply any additional bed dressing pieces 350 as desired and engage as many fasteners 440 thereon as needed or desired with the loops 450.

The bed dresser may then finish the bed dressing by applying one or more pillow cases 370 with pillows 430 as described above. It should be noted that this step of dressing a bed can occur at any point in the process of dressing the bed as desired by the bed dresser.

Such a method of dressing bed has substantial utility and potentially widespread application. For example, hotel, resort, and other professional housekeeping staff benefit from such a bed dressing 100 and method of dressing of bed because of the speed with which a bed can be dressed, and with a reduction in the strain on such professional housekeeping staff from, for example, having to lift mattresses to tuck sheets thereunder. By speeding up the time it takes to dress beds and making the work in doing less burdensome, businesses needing such professional housekeeping services can realize substantial reduction in costs.

Additionally, the bed dressing 100 and method of dressing a bed according to the present invention has substantial utility and application in the home. Caregivers have a strong need to quickly dress children's or adult's beds to be able to attend to other tasks faster. Additionally, cleanliness and appearance are also important factors in homes, as well as in businesses like hotels and resorts. The present invention, as noted above, not only reduces the time it takes to dress a bed, but it also improves bed clothing cleanliness and appearance for the reasons noted above.

In another embodiment of the present invention, a method of dressing a bed comprises aligning a marker centrally positioned on a foot end of a bottom sheet with a center portion of a first end of a mattress, and deploying a foot end strap arrangement onto a bottom surface of the mattress. The method also includes aligning a marker centrally positioned on a head end of the bottom sheet with a center portion of a second end of the mattress, and deploying a head end strap arrangement onto the bottom surface of the mattress, so that the foot end strap arrangement and the head end strap arrangement firmly secure the bottom sheet to the mattress. The method further includes positioning a top sheet above the bottom sheet and engaging one or more apertures along each of a left side a right side of the top with fasteners positioned along each of a left side and a right side of the bottom sheet, leaving the top sheet open at each of its head end and its foot end relative to the bottom sheet so that the top sheet is untucked underneath the mattress, forming a gap between the foot end of the top sheet and the foot end of the bottom sheet. The method continues by adding one or more additional bed dressing pieces by engaging one or more apertures along each of a left side and right side of each additional bed dressing piece with the fasteners positioned along each of the left side and the right side of the bottom sheet. The method may also include inserting a pillow into at least one pillow case and securing the pillow inside the pillow case by rolling an open end of the pillow case toward a closed end and folding a flap of an internal pocket positioned inside each pillow case over one end of the pillow to secure the pillow therein, and unrolling the open end of the pillow case to cover the internal pocket so that the pillow is fully covered by the at least one pillow case. Such a method may also include providing a set of instructions regarding how to dress a bed. Adding one or more bed dressing pieces may also further comprise engaging a blanket with the bottom sheet, and engaging at least one of a comforter, a duvet, and a bed spread to the bottom sheet.

In still another embodiment of the present invention, the top sheet 110 and bottom sheet 120 are capable of being applied as furniture fabric, including armature such as slip covers for protecting furniture fabric or as fabric for upholstering furniture. In this embodiment, furniture or pillows may include a basic, solid slip cover. Each slip cover includes a plurality of apertures, such as button holes, which may be designed so as to be unobtrusive when no additional fabrics are applied thereto. To enhance this slip cover, for example for either a change or a seasonal spruce up, a top sheet that is a compatible piece of cloth or fabric with a plurality of fasteners may be applied to the slip cover and fastened thereto with the plurality of apertures. Such a design reduces wear and tear on the slip cover and on the furniture body or pillow itself. Where applied to a pillow, a basic slip cover is included to cover the pillow, and varying cloth or other fabric top pieces may be applied to fasten to the apertures.

In a variation of this embodiment, where applied to furniture, the plurality of fasteners may be included on the slip cover applied to the furniture body and capable of coupling with apertures in the top sheet as in the embodiment of FIG. 1. Regardless, the present invention may be applied to furniture to permit adjustable positioning of furniture fabrics, to allow for interchangeable fabrics to be applied, and to allow for easy cleaning and replacement of furniture fabrics. Different top sheets may be included in a set of furniture fabrics, so that different color or fabric combinations may be applied as desired by users. The present invention may be further applicable to furniture such as sleeper sofas, where bottom sheet fabrics may be used as normal day-to-day furniture coverings, and top sheet fabrics may be applied to easily convert the furniture into a bed to allow for a clean, removable sleeping environment for a user of the sleeper sofa. Pillows may additionally be outfitted with a slip cover and a top sheet and the plurality of fasteners 210, so that both the furniture body itself and the pillows may each have separate top sheets and slip covers to allow for many different combinations of colors and fabrics, and to allow for easy and convenient cleaning and dressing.

In a further variation, slip covers for furniture and pillows may include slits or openings that serve as attachment points for top sheets that are compatible pieces of cloth or fabric. As with top sheets that adhere using the plurality of fasteners and apertures, these top sheets can be removed entirely to create new and fresh looks, and for cleaning. The top sheets may be comprised of fabric swatches that attach with cuffed fabric portions to the base slip cover pillow and furniture fabrics by being threaded through the slits or openings therein. While the cuffed fabric and slits or openings offer hidden attachment places, other types of attachment mechanisms may also be utilized, such as fashionable snaps or zippers. Fastening mechanisms may also be positioned on an underside portion of each slip cover for furniture and pillows. Regardless, the embodiment contemplates that replaceable and removable top sheets for both furniture and pillows that stay in place with sturdy attachment mechanisms may be employed to create new looks and make dressing and cleaning easier.

Still another embodiment of the present invention provides a safety bed dressing 100 for infants in cribs. Presently, infants are dressed in sleep suits for warmth when sleeping, as formal bed dressings are strongly discouraged for safety reasons. In the present invention, a crib bottom sheet may be designed to avoid displaced bed coverings linked to infant safety issues. It is contemplated that a fitted bottom sheet for a crib may include unobtrusive slits or openings along the head, left, right, and/or foot ends of the fitted bottom sheet. The embodiment includes a top sheet that is capable of threading through the slits or openings in the fitted bottom sheet, so that fastening occurs out of harm's way for the infant occupying the crib. The top sheet may also be tailored in age-appropriate sizes, and may resemble a pocket. Sizing for the top sheet covering or pocket may occur as is similar with infant and toddler clothing, which are sized according to age, for example 0-3 months, 3-6 months 6-9 months 9 months-1 year, etc. Top sheet coverings may therefore also be vented due to the slits and openings fastening method, to promote air flow in the crib bed dressing and to avoid overheating. The pocket created by the top sheet covering would therefore also fasten with circulation considered. Compatible pocket-sized additional bed clothes may also fasten either through the slits or in a safety cuff that lies around a perimeter of the top sheet.

In yet another embodiment of the present invention, the top sheet and the bottom sheet are capable of being applied to a sleeping bag. In this embodiment, a sleeping bag for use in a traditional way, such as for one person, may include a bottom layer that includes apertures that fasten to a variety of top layers comprising compatible fastening mechanisms. Top layers may be designed for climatic or seasonal change, as well as simply to incorporate fun new looks and designs. Sleeping bags in this embodiment, regardless of size, may have the option of being fully unzipped. Various top layers may be applied to the open sleeping bag palate, so that the weight of the top layer may also be variable to accommodate changes in user weight, for example as a child grows, or simply to change style as the child matures. Sleeping bags according to this embodiment do not need to be replaced over time as children develop, resulting in a cost-effective, long-lasting purchased for the consumer, while also creating fun design options from mixing and matching materials, colors, and patterns.

In a variation similar to the embodiment of FIG. 1, a bottom layer may be applied to a bottom portion of a sleeping bag and may include fasteners that are capable coupling with apertures in a top layer applied to a top portion of the sleeping bag. Likewise, similar to the embodiment of FIG. 5, a bottom layer may be applied to a bottom portion of a sleeping bag and may include loops that are capable of coupling with fasteners in a top layer applied to a top portion of the sleeping bag.

Together, the top layer and the bottom layer allow the sleeping bag to be prepared so that the top layer engages with the bottom layer using the fasteners applied to the apertures or loops, depending on the variation. When both the top layer and the bottom layer are applied to a sleeping bag, and fully or partially attached together as described above, both a head end and a foot end of the top layer are loose and do not need to be otherwise secured. A foot end of the sleeping bag may incorporate at least one fastener to be coupled to at least one aperture or loop to provide a closed end for the sleeping bag so that the sleeping bag takes a more conventional form. Regardless, application of the inventive concepts described herein to a sleeping bag environment has several advantages and benefits.

One such advantage and benefit is that a person, particularly a child, occupying the sleeping bag remains snug between the top portion and the bottom portion. This occurs while permitting a free flow of air in the sleeping bag, allowing the occupant to sleep peacefully without getting too warm inside a three-sided, closed conventional sleeping bag. Another advantage is the ability to remove the top layer and the bottom layer from the top portion and bottom portion, respectively, permitting the top layer and the bottom layer to be easily cleaned and changed when necessary or to alter the appearance of the sleeping bag.

It is to be understood that other embodiments will be utilized and structural and functional changes will be made without departing from the scope of the present invention. The foregoing descriptions of embodiments of the present invention have been presented for the purposes of illustration and description. It is not intended to be exhaustive or to limit the invention to the precise forms disclosed. Accordingly, many modifications and variations are possible in light of the above teachings. For example, the present invention may also include a pet embodiment that is configurable to provide a comfortable and tidy sleeping environment for pets, such as dogs and cats. It is therefore intended that the scope of the invention be limited not by this detailed description.

The invention claimed is:

1. A bed dressing comprising:

a top sheet having a plurality of apertures positioned along and near each of a left end and a right end thereof for accepting at least one fastener on a bottom sheet that is configured to securely affix to a mattress of a bed, the top sheet capable of being removably attached to the bottom sheet so that both of a head end of the top sheet and a foot end of the top sheet are loose relative to the bottom sheet and to a mattress, the bottom sheet having an edge, four ends that include a head end, a foot end, a left end and a right end, a fitted portion extending substantially along the edge, a foot end strap arrangement in which a first strap extends from a substantially central position along the foot end to a first point on the left end and a second strap extends from the substantially central portion along the foot end to a first point on the right end so that the first strap and the second strap of the foot end strap arrangement are stitched at the substantially central portion proximate to each other at the foot end so as to angularly extend away from each other to substantially form a "V" shape at the foot end, and a head end strap arrangement in which a first strap extends from a substantially central position along the head end to a second point on the left end and a second strap extends from the substantially central portion along the head end to a second point on the right end so that the first strap and the second strap of the head end strap arrangement are stitched at the substantially central portion proximate to each other at the head end so as to angularly extend away from each other to substantially form a "V" shape from the head end opposing the "V" shape at the foot end, the first and second points on the left end and the first and second points on the right end each being proximate to a placement of at least one fastener among a plurality of fasteners and substantially central on the left end and the right end of the bottom sheet so that when the plurality of fasteners secure an occupant between the top sheet and the bottom sheet, the head end strap arrangement and the foot end strap arrangement securely situate the bottom sheet in a fixed and stable position relative to a mattress at each of the head end, foot end, left end and right end of the bottom sheet when deployed, to prevent any dislodge of the bottom sheet from the mattress when in use by the occupant and at the same time enabling the top sheet to couple to the bottom sheet so that the top sheet remains open and untucked at both the head end and the foot end to create a free flow of air for the occupant.

2. The bed dressing of claim 1, wherein the edge of the bottom sheet includes the fitted portion along an entire length of the edge of the bottom sheet.

3. The bed dressing of claim 1, further comprising an identification portion positioned near at least one of the substantially central portion along the foot end of the bottom sheet and the substantially central portion along the head end of the bottom sheet.

4. The bed dressing of claim 1, further comprising at least one additional bed dressing piece having apertures positioned along and near each of a left end and a right end thereof.

5. The bed dressing of claim 4, where the apertures of the at least one additional bed dressing piece accept the at least one fastener of the bottom sheet.

6. The bed dressing of claim 5, wherein the at least one bed additional bed dressing piece is a blanket.

7. The bed dressing of claim 5, wherein the at least one additional bed dressing piece is a bed covering that includes at least one of a comforter, a duvet, and a bed spread.

8. A bed dressing set comprising:

a bottom sheet having a first strap arrangement connecting a foot end to each of a left side and a right side, and a second strap arrangement connecting a head end to each of the left side and the right side, and at least one fastener substantially central to each of the left side and the right side and projecting from an outer surface of the bottom sheet, the first strap arrangement and the second strap arrangement each being stitched at a substantially central portion at the head end and at the foot end of the bottom sheet, respectively, and proximate to each other, so that straps connecting the head end and the foot end to the left side and the right side of the bottom sheet angularly extend away from each other to substantially form a "V" shape at each of the head end and the foot end;

a top sheet having a plurality of apertures near each of a left side and a right side thereof;

one or more additional bed dressing pieces each having a plurality of apertures near each of a left side and a right side of each of the one or more additional bed dressing pieces; and at least one pillow case having a closed end, an open end, and an internal pocket formed on an inside portion, the internal pocket having an opening where a flap is positioned to fold over one end of a pillow and secure the pillow inside the internal pocket so that the pillow does not protrude through the open end of the pillow case, wherein the straps connecting the head end and the foot end to the left side and the right side of the bottom sheet meet the left side and the right side of the bottom sheet at substantially central points proximate to a placement of the at least one fastener on each of the left side and the right side of the bottom sheet, so that when the at least one fastener secures an occupant between the top sheet and the bottom sheet, the head end strap arrangement and the foot end strap arrangement securely situate the bottom sheet in a fixed and stable position relative to a mattress at each of the head end, foot end, left side and right side of the bottom sheet to prevent any dislodge of the bottom sheet from the mattress when in use by the occupant, and at the same time enabling the top sheet to couple to the bottom sheet so that the top sheet remains open and untucked at both the head end and the foot end to create a free flow of air for the occupant.

9. The bed dressing set of claim 8, wherein the first and second strap arrangements allow the bottom sheet to remain securely situated in a stable position on a mattress of a bed when the strap arrangements are deployed underneath the mattress.

10. The bed dressing set of claim 8, wherein the plurality of apertures in the top sheet and the one or more additional bed dressing pieces engage the top sheet and the one or more additional bed dressing pieces to the bottom sheet with the at least one fastener on each of the left side and the right side of the bottom sheet so that head ends and foot ends of the top sheet and the one or more additional bed dressing pieces remain loose and untucked relative to the bottom sheet and to the mattress.

11. The bed dressing set of claim 8, wherein the one or more additional bed dressing piece is a blanket.

12. The bed dressing set of claim 8, wherein the one or more additional bed dressing piece is a bed covering that includes at least one of a comforter, a duvet, and a bed spread.

13. The bed dressing set of claim 8, wherein the strap arrangements of the head end and the foot end of the bottom sheet each include a first cross strap and a second cross strap extending out from a centrally-positioned alignment marker at each of the head end and the foot end of the bottom sheet.

14. The bed dressing set of claim 8, wherein the bottom sheet, the top sheet, the at least one additional bed dressing piece, and the at least one pillowcase are packaged together with a set of instructions relating to optimally dressing a bed.

15. A bed dressing comprising:

a bottom sheet having an edge, four ends that include a head end, a foot end, a left end and a right end, a fitted portion extending substantially along the edge, a foot end strap arrangement in which a first strap extends from a substantially central position along the foot end to a first point on the left end, and a second strap extends from the substantially central portion along the foot end to a first point on the right end, and a head end strap arrangement in which a first strap extends from a substantially central position along the head end to a second point on the left end, and a second strap extends from the substantially central portion along the head end to a second point on the right end, the first strap and the second strap of each of the head end and foot end strap arrangements being stitched at the substantially central position at the head end and at the foot end, respectively, and proximate to each other, so that the straps connecting the head end and the foot end to the left end and right end of the bottom sheet angularly extend away from each other to substantially form a "V" shape at each of the head end and the foot end;

a top sheet capable of being removably attached to the bottom sheet so that both of a head end of the top sheet and a foot end of the top sheet are loose, adjustable, and untucked relative to the bottom sheet and to the mattress;

a plurality of apertures positioned along and near each of the right end, the left end, and foot end of one of the top sheet and the bottom sheet and capable accepting through the aperture at least one fastener positioned near each of a left end, a right end, and a foot end of the other of the top sheet and the bottom sheet, wherein the first and second points on the left end and the first and second points on the right end are each proximate to a placement of the at least one fastener and substantially central on the left side and the right side of the bottom sheet so that when the at least one fastener secures an occupant between the top sheet and the bottom sheet, the head end strap arrangement and the foot end strap arrangement securely situate the bottom sheet in a fixed and stable position relative to a mattress at each of the head end, foot end, left end and right end of the bottom sheet when deployed, to prevent any dislodge of the bottom sheet from the mattress when in use by the occupant and at the same time enabling the top sheet and the bottom sheet to couple so that the top sheet remains open and untucked at both the head end and the foot end to create a free flow of air for the occupant;

at least one additional piece of bed clothing having a plurality of apertures along near each of right, left, and foot ends thereof and capable of being removably attached to at least one of the bottom sheet and top sheet so that both of a head end of the at least one additional piece of bed clothing and a foot end of the at least one additional piece of bed clothing are loose, adjustable, and untucked relative to the bottom sheet and to the mattress; and at least one pillow case having a closed end, an open end, and an internal pocket formed on an inside portion, the internal pocket having an opening where a flap is positioned to fold over one end of a pillow and secure the pillow inside the internal pocket so that the pillow does not protrude through the open end of the pillow case.

16. The bed dressing of claim 15, wherein the one or more additional bed dressing piece is a bed covering that includes at least one of a blanket, a comforter, a duvet, and a bed spread.

17. The bed dressing of claim 15, wherein the bottom sheet, the top sheet, the at least one additional bed dressing piece, and the at least one pillowcase are packaged together with a set of instructions relating to optimally dressing a bed.

18. The bed dressing of claim 15, wherein the top sheet includes a plurality of apertures and the bottom sheet includes a plurality of fasteners in a bed dressing for application to a child's bed.

19. The bed dressing of claim 15, wherein the top sheet includes a plurality of fasteners and the bottom sheet includes a plurality of loops in a bed dressing for application to an adult's bed.

20. The bed dressing of claim 19, wherein the foot end of the top sheet includes one substantially centrally positioned fastener to engage with a substantially centrally positioned loop at the foot end of the bottom sheet.

* * * * *